US007191523B2

(12) United States Patent
Miyazaki et al.

(10) Patent No.: US 7,191,523 B2
(45) Date of Patent: Mar. 20, 2007

(54) SAFETY RAZOR

(75) Inventors: Hiroaki Miyazaki, Seki (JP); Hiroyuki Nakasuka, Seki (JP)

(73) Assignee: Kai R&D Center Co., Ltd, Gifu (JP)

( * ) Notice: Subject to any disclaimer, the term of this patent is extended or adjusted under 35 U.S.C. 154(b) by 0 days.

(21) Appl. No.: 10/483,894

(22) PCT Filed: Jul. 16, 2002

(86) PCT No.: PCT/JP02/07219

§ 371 (c)(1),
(2), (4) Date: Jan. 13, 2004

(87) PCT Pub. No.: WO03/008158

PCT Pub. Date: Jan. 30, 2003

(65) Prior Publication Data

US 2004/0177511 A1 Sep. 16, 2004

(30) Foreign Application Priority Data

Jul. 17, 2001 (JP) ..... 2001-217021

(51) Int. Cl.
*B26B 21/00* (2006.01)
*B26B 21/02* (2006.01)

(52) U.S. Cl. ..... 30/50; 30/47; 30/346.5; 30/346.57

(58) Field of Classification Search ..... 30/50, 30/41, 49, 41.5, 30, 31.32, 47, 48, 52, 80, 30/83, 77, 79, 90, 57, 346, 58, 59, 346.5, 30/346.57, 56, 60.5, 345.57, 538, 539, 346.58

See application file for complete search history.

(56) References Cited

U.S. PATENT DOCUMENTS 3,940,853 A * 3/1976 Francis ..... 30/346.58
4,016,648 A 4/1977 Chen et al.
4,200,976 A * 5/1980 Gooding ..... 30/47

(Continued)

FOREIGN PATENT DOCUMENTS

| | | |
|---|---|---|
| EP | 0 858 869 A1 | 8/1998 |
| JP | 55-034061 A1 | 3/1980 |
| JP | 03063090 | 3/1991 |
| JP | 9-135972 A1 | 5/1997 |

(Continued)

OTHER PUBLICATIONS

Search Report issued in European Application No. EP 0 274 6096.

*Primary Examiner*—Boyer D. Ashley
*Assistant Examiner*—Ghassem Alie
(74) *Attorney, Agent, or Firm*—Darby & Darby

(57) ABSTRACT

A safety razor with a plurality of blades comprising a head provided with a plurality of vertically adjacent blades, which do not wholly overlap one another, and blade support parts supporting the respective blades apart from one another in order to retain the respective blades at spaces, and wherein non-overlapping portions, which do not overlap one another, are formed on supported portions of the respective blades and the blade support parts are held to the non-overlapping portions of the blades to support the blades. A support structure can be divided into two members to be manufactured and mechanically assembled, metal molds are not so much complicated, and mechanical assembly of blades is made possible to prevent degradation in yield.

8 Claims, 16 Drawing Sheets

U.S. PATENT DOCUMENTS

| | | | | |
|---|---|---|---|---|
| 4,337,575 | A * | 7/1982 | Trotta | 30/47 |
| 4,389,773 | A * | 6/1983 | Nissen et al. | 30/50 |
| 4,403,412 | A * | 9/1983 | Trotta | 30/47 |
| 4,535,537 | A | 8/1985 | Ferraro et al. | |
| 4,562,644 | A * | 1/1986 | Hitchens | 30/41 |
| 5,070,612 | A * | 12/1991 | Abatemarco | 30/50 |
| 5,666,729 | A * | 9/1997 | Ferraro | 30/50 |
| 5,781,997 | A * | 7/1998 | Ferraro et al. | 30/50 |
| 5,822,862 | A * | 10/1998 | Ferraro | 30/50 |
| 6,305,084 | B1 * | 10/2001 | Zucker | 30/50 |
| 6,430,818 | B1 * | 8/2002 | Wonderley | 30/346.57 |
| 6,944,952 | B1 * | 9/2005 | Tseng | 30/41 |
| 2002/0046465 | A1 * | 4/2002 | McCool et al. | 30/50 |
| 2002/0157259 | A1 * | 10/2002 | Coffin | 30/50 |
| 2003/0046819 | A1 * | 3/2003 | Ferraro et al. | 30/527 |

FOREIGN PATENT DOCUMENTS

| | | | |
|---|---|---|---|
| JP | 9-187585 | A1 | 7/1997 |
| JP | 2757157 | B2 | 3/1998 |
| JP | 2987688 | B2 | 10/1999 |
| JP | 2000-308771 | A1 | 11/2000 |

* cited by examiner

SAFETY RAZOR

TECHNICAL FIELD

The present invention relates to a safety razor having a plurality of blades, and more particular, to a structure, in which respective blades are supported at spaces.

BACKGROUND ART

A safety razor having a plurality of blades suffers from accumulation of moustache refuse, cream, or the like between blades in use, and so a safety razor intended for efficient removal of these has been proposed. JP-A-2000-308771 discloses a support structure, in which a plurality of blades are supported at spaces. This support structure comprises a plurality of blades and a frame supporting the plurality of blades, a plurality of vertical ribs are arranged between opened rear portions of the frame, and the ribs comprise slots, which are different in level and in which rear edges of the blades are mounted.

A conventional support structure is configured in the above-mentioned manner such that rear edges of the blades are mounted in the slots provided on the ribs. In this manner, with the support structure, in which blades are fixed by means of slots, it is difficult to separately manufacture several support structure parts to mechanically assemble them, so that the whole support structure together with blades is molded by fixing the blades in predetermined positions and injection molding plastics. Cartridge replaceable blades are manufactured by such injection molding.

However, there is a disadvantage that metal molds used in injection molding to manufacture a whole cartridge replaceable blade in a body are very complicated to lead to an increase in cost. Also, it is not easy to fix a plurality of blades at spaces at the time of injection molding, which incurs a fear of bad yield.

Hereupon, it is an object of the invention to provide a constitution, in which a support structure is divided into two members to be manufactured and mechanically assembled and metal molds are not so much complicated.

Further, it is an object of the invention to enable mechanical assembly of blades and prevent degradation in yield.

Further, with a safety razor having a plurality of blades, respective blade bodies are partially fixed midway in order to efficiently eject moustache refuse, which has been clogged between the blades, rearward, whereby spaces between blade bodies are retained. Therefore, there is a fear that blade bodies bend at unfixed portions thereof. Also, when a safety razor having a plurality of blades is assembled, the blades are stacked on one another, but the stacked blades can be shifted relative to one another due to vibrations prior to fixation of the blades, which leads to a bad yield. Hereupon, it is an object of the invention to provide a safety razor, assembly of which can be readily and surely performed and in which blades after assembly are surely fixed.

DISCLOSURE OF THE INVENTION

The present invention has a feature in that a head is provided with a plurality of vertically adjacent blades, which do not wholly overlap one another, and blade support parts supporting the respective blades apart from one another in order to retain the respective blades at spaces, and that non-overlapping portions, which do not overlap one another, are formed on supported portions of the respective blades and the blade support parts are held to the non-overlapping portions of the blades to support the blades.

The present invention also includes an embodiment in which when the blades are provided with holes or notches, the non-overlapping portions are present on at least any one of blade edges, which include edges of the holes or notches.

According to one embodiment, the non-overlapping portions are present on front and rear edge portions of the blades, and according to another aspect of the present invention, the respective blades are formed to be rectangular in shape and provided with holes, and the non-overlapping portions are present on inner periphery front edges and inner periphery rear edges of the holes.

According to one embodiment, the respective blades are formed to have the same external shape, and vertically adjacent blades are shifted relative to each other to produce the non-overlapping portions, and the razor according to another embodiment is constituted such that the respective blades are provided at both ends thereof with notches, a shape of which is obtained by dividing the hole into two halves, and the non-overlapping portions are present on inner periphery front edges and inner periphery rear edges of the notches.

According to yet another embodiment, a plurality of blades are supported between a blade base and a roof plate and that those blade support parts, which are provided integrally on the blade base to project therefrom, support the non-overlapping portions of those blades, which are disposed above a lower blade, from under and those blade support parts, which are provided integrally on the roof plate to project therefrom, support the non-overlapping portions of those blades, which are disposed below an upper blade, from above, whereby the respective blades are supported in different levels.

According to the present invention the non-overlapping portions of those blades, which are supported by the blade support parts of a blade base, are composed of both sides of rear edges of the blades, inner periphery front edges of the holes, and inner periphery front edges of notches, and the non-overlapping portions of those blades, which are supported by the blade support parts of a roof plate, are composed of both sides of front edges of the blades, inner periphery rear edges of the holes, and inner periphery rear edges of notches.

According to one aspect of the present invention, projections themselves are formed projecting from a bottom surface of a roof plate to be inserted through holes of the respective blades and holes of a blade base in order to interpose the blades between the blade base and the roof plate support those blades, which are disposed below an upper blade. Also, according to claim 10, steps are provided midway the projections and the steps support the non-overlapping portions of those blades, which are disposed below the upper blade, from above.

The invention according to another embodiment has a feature in that a head is provided with three or more vertically adjacent blades, which do not wholly overlap one another, and blade support parts supporting the respective blades apart from one another in order to retain the respective blades at spaces, and that non-overlapping portions, which do not overlap one another, are formed on supported portions of the respective blades and the blade support parts are held to the non-overlapping portions of the blades to support the blades.

According to another aspect of the present invention, projections themselves are provided projecting from a bottom surface of a roof plate to be inserted through holes of the respective blades and holes of a blade base in order to interpose the blades between the blade base and the roof plate support those blades, which are disposed below an upper blade. According to another embodiment, steps are provided midway the projections and the steps support those blades, which are disposed below the upper blade, from above, and according to yet another feature, the number of steps supporting those blades, which are disposed below the upper blade, corresponds to the number of blades minus 1.

According to another aspect of the present invention, a plurality of blade support parts supporting the blades are changed relatively in level whereby all or a part of the blades are supported to be non-parallel. According to claim 16, an extension line extending ahead of a blade edge from a lower blade and an extension line extending ahead of a blade edge from an upper blade intersect each other ahead of the blade edges. In contrast with this, according to another feature of the present invention, an extension line extending ahead of a blade edge from a lower blade and an extension line extending ahead of a blade edge from an upper blade are increased in spacing as they go ahead of the blade edges. According to yet another aspect of the present invention, moustache refuse, cream, or the like is discharged through gaps between the respective blades from a rear end opening of the head.

The present invention can be configured such that three or more blades are provided, and a spacer member is present between a lower blade and blades above the lower blade. The spacer member is provided with an insertion hole, a tip end of a projection extending through the upper blade and the respective middle blades from a bottom surface of a roof plate is inserted through the insertion hole, a rear end of the spacer member is provided with an upward directed projection, and the projection bears on the upper blade with a non-overlapping portion of the blade therebetween.

The present invention according to one exemplary embodiment is directed to a safety razor comprising a plurality of blades mounted at predetermined spaces on a head and an insert spacer inserted between the blades from a rear end opening of the head to be fixed. The invention according to another embodiment is directed to a safety razor comprising three or more blades, and wherein a plurality of insert pieces project from a base end of the insert spacer to be different in level, and the respective insert pieces are inserted between the respective blades. At least one of the vertically adjacent insert pieces is laterally provided in plural, and the vertically adjacent insert pieces are alternately arranged laterally.

With the invention constituted in the above-mentioned manner, the blade support parts are held to the non-overlapping portions of the blades to thereby support the respective blade bodies apart from one another. That is, instead of fixing blades integrally in slots by means of injection molding, the blade support parts are held to the non-overlapping portions of the blades to support the blades, so that mechanical assembly of support structure parts is made possible. Accordingly, metal molds are not so much complicated and it is not necessary to fix blade bodies to perform injection molding, so that manufacture is simple and inexpensive as compared with conventional products. Also, degradation in yield is eliminated.

According to one aspect of the present invention, projections themselves projecting from a bottom surface of a roof plate can be inserted through holes of the respective blades and holes of a blade base in order to interpose the blades between the blade base and the roof plate support those blades, which are disposed below an upper blade. Accordingly, even when blade body supports and blade base inserts are not formed separately, the projections serve as both parts to produce an effect that the constitution is made simple and cost is reduced.

According to one exemplary embodiment, the number of steps provided on the projections to support those blades, which are disposed below the upper blade, corresponds to the number of blades minus 1. Accordingly, all blades disposed below the upper blade are supported by the respective steps, so that it is possible to stably support the blades.

According to one exemplary embodiment, three or more blades are provided, and a spacer member is present between a lower blade and blades above the lower blade. The spacer member is provided with an insertion hole, a tip end of a projection extending through the upper blade and the respective middle blades from a bottom surface of a roof plate is inserted through the insertion hole, a rear end of the spacer member is provided with an upward directed projection, and the projection bears on the upper blade with a non-overlapping portion of the blade therebetween. When blade bodies are shifted and a safety razor is assembled, the roof plate is placed in an inverted position, a plurality of blades are shifted and stacked in a stepwise manner, and the blade base is held thereto to be fixed. And when the blade base is held to an associated part, there is a fear that middle blades placed in a stepwise manner are shifted due to vibrations of an associated machine to fall on blades disposed below, but the spacer member is stacked to push the blades disposed below, thus enabling preventing the blades from being shifted. Also, while the lower blade meets with largest resistance from moustache, the spacer member holds the lower blade down to enable surely fixing the lower blade.

As described above, in recent years, with a safety razor having a plurality of blades, respective blade bodies are partially fixed midway in order to efficiently eject moustache refuse, which has been clogged between the blades, rearward, and spaces between blade bodies are retained. Therefore, there is a fear that blade bodies bend at unfixed portions thereof. According to one embodiment, a safety razor includes a plurality of blades mounted at predetermined spaces on a head and an insert spacer inserted between the blades from a rear end opening of the head to be fixed. Accordingly, the respective blades can be surely and simply fixed by manufacturing an insert spacer and mounting the same on a safety razor.

At least one of the vertically adjacent insert pieces is laterally provided in plural, and the insert pieces vertically adjacent to the ones are alternately arranged laterally. Accordingly, the insert pieces can be easily inserted into the head as compared with the case where vertically adjacent insert pieces fully overlap each other.

DETAILED DESCRIPTION OF THE PREFERRED EMBODIMENTS

Figure 1:
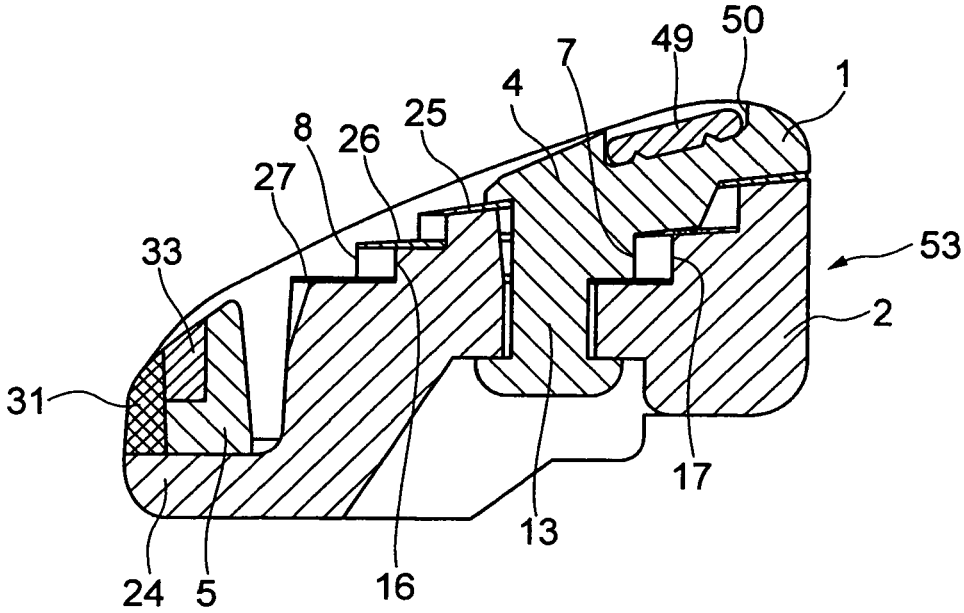
FIG. 1 is a cross sectional view of a safety razor according to one embodiment of the present invention, taken along the line B—B in FIG. 3.

Embodiments of the invention will be described below with reference to the drawings. The drawings show a cartridge replaceable blade having three blades, the cartridge replaceable blade corresponding to a head 53 of a safety razor, and a support structure for blades comprising a roof plate 1 and a blade base 2. The roof plate 1 comprises a blade pressure foot 4 between both side portions 3, 3, and a guard body 5 extending between both front ends of the both side portions 3, 3 and interposing an opening 6 between it and the blade pressure foot 4. Edges of the blades are exposed from the opening 6. Also, a shaving aid 49 is fixed in a recess 50 provided on an upper surface of the blade pressure foot 4. Since two ridges are provided on a bottom of the recess 50, the shaving aid 49 is firmly fixed. Of course, the invention is not limited to cartridge replaceable blades but may be applied to safety razors, in which a blade base and a handle are integrally formed.

Figure 2:
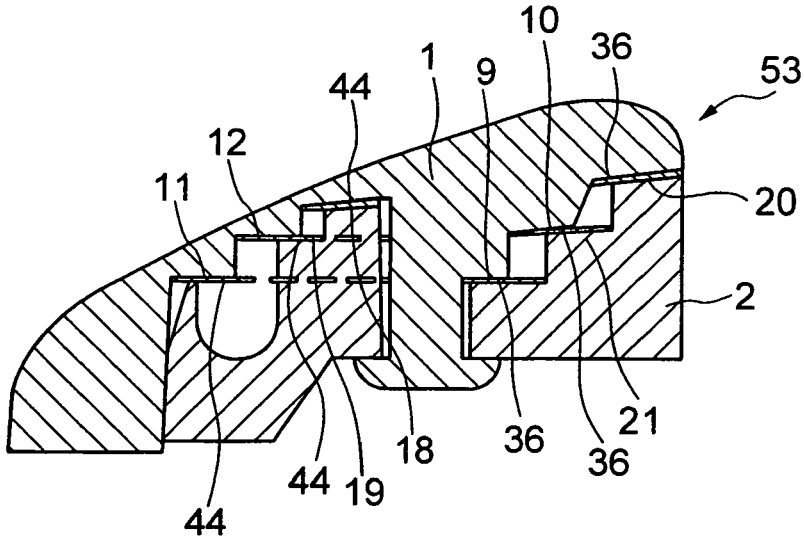
FIG. 2 is a cross sectional view of the safety razor taken along the line A—A in FIG. 3.
Figure 3:
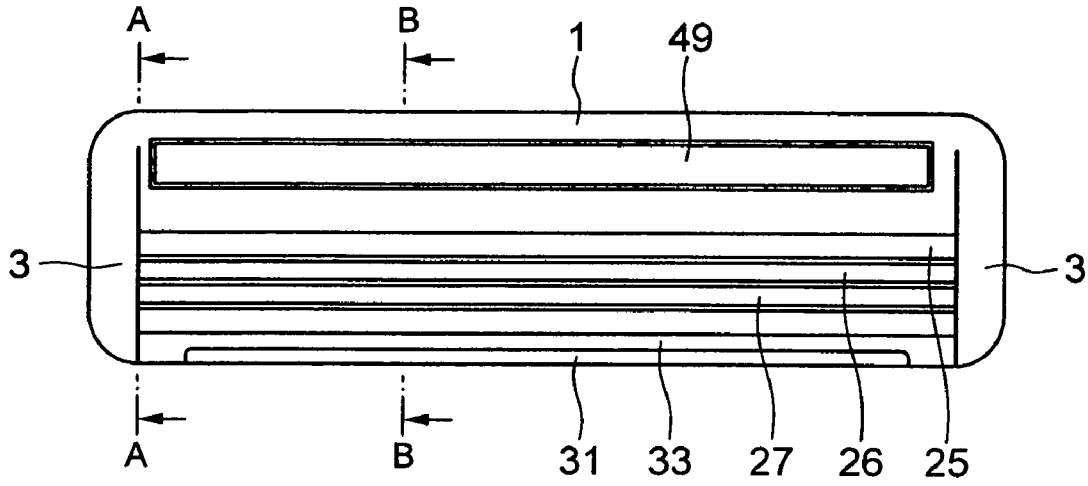
FIG. 3 is a top plan view of the safety razor showing a head thereof.
Figure 4:
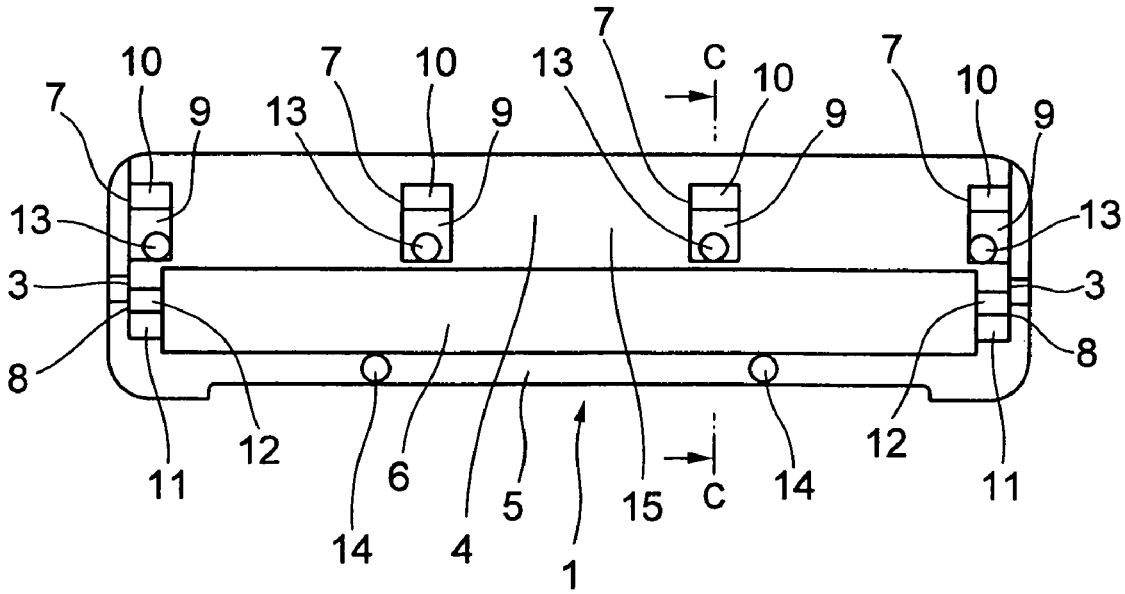
FIG. 4 is a bottom view of the safety razor showing a roof plate.
Figure 5:
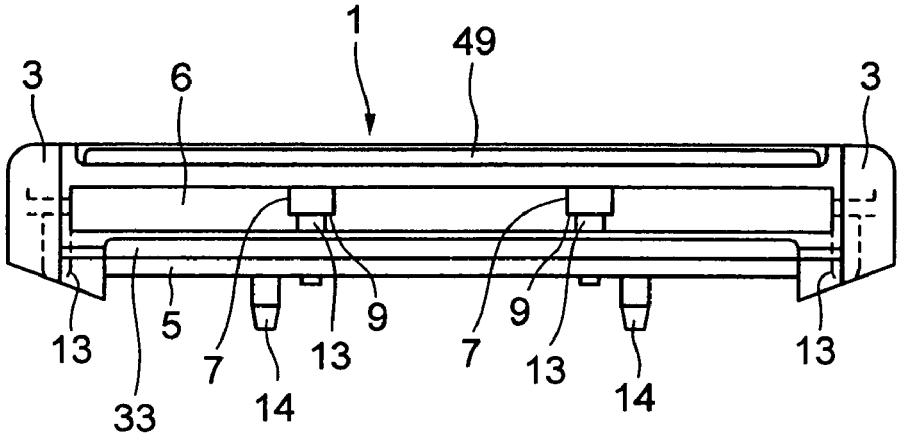
FIG. 5 is a front view of the roof plate of FIG. 4.
Figure 6:
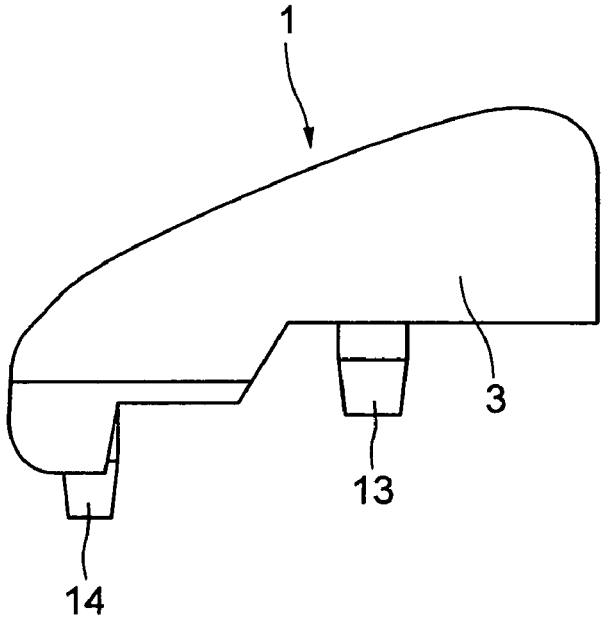
FIG. 6 is a side view of the roof plate of FIG. 4.
Figure 7:
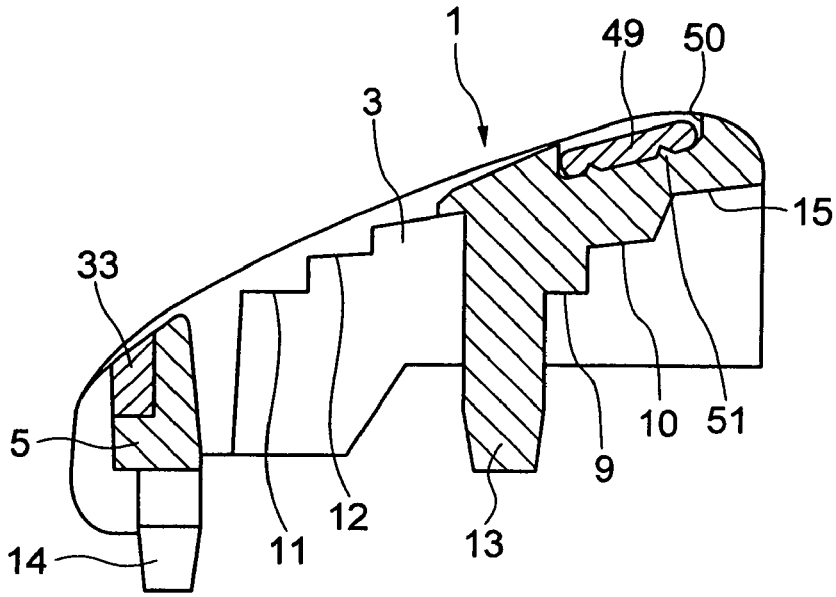
FIG. 7 is a cross sectional view of the safety razor taken along the line C—C in FIG. 4.

As shown in FIGS. 1 and 2, blade support parts are formed stepwise. FIG. 4 is a bottom view showing the roof plate 1, and as shown in the figure, four first blade support parts 7 are arranged on a bottom surface of the blade pressure foot 4. The blade pressure foot 4 together with blade base inserts 13 projects as integral projections from a bottom surface of the roof plate. Also, two second blade support parts 8 are provided on bottom surfaces of the both side portions 3, 3 to be positioned forwardly of the first blade support parts 7. As described above, the blade support parts are formed to be stepwise, and steps comprise two steps composed of a second step and a first step. For the first blade support parts 7, the second step 9 is positioned forward and the first step 10 is positioned rearward. For the second blade support parts 8, the second step 11 is positioned forward and the first step 12 is positioned rearward. As described later, the second steps 9 and the first steps 10 in the respective blade support parts 7, 8 abut against non-overlapping portions of the respective blades to support the blades.

As described above, the reference numeral 13 denotes blade base inserts projecting from the second steps 9 of the first blade support parts to extend through holes in the blades and the blade base to fix the blades between the blade base and the roof plate 1. The blade base inserts are not limited to a circular shape in cross section but may be rectangular in cross section. In the case where the blade base inserts are rectangular in cross section, they preferably have the same width as that of the first blade support parts 7. Also, the reference numeral 14 denotes projections provided on a bottom surface of the guard body 5 to extend through holes in the blade base to join the blade base 2 and the roof plate 1 together. Also, since a shaving aid 33 is present on a surface of the guard body 5, it is possible to perform shaving smoothly.

Figure 8:
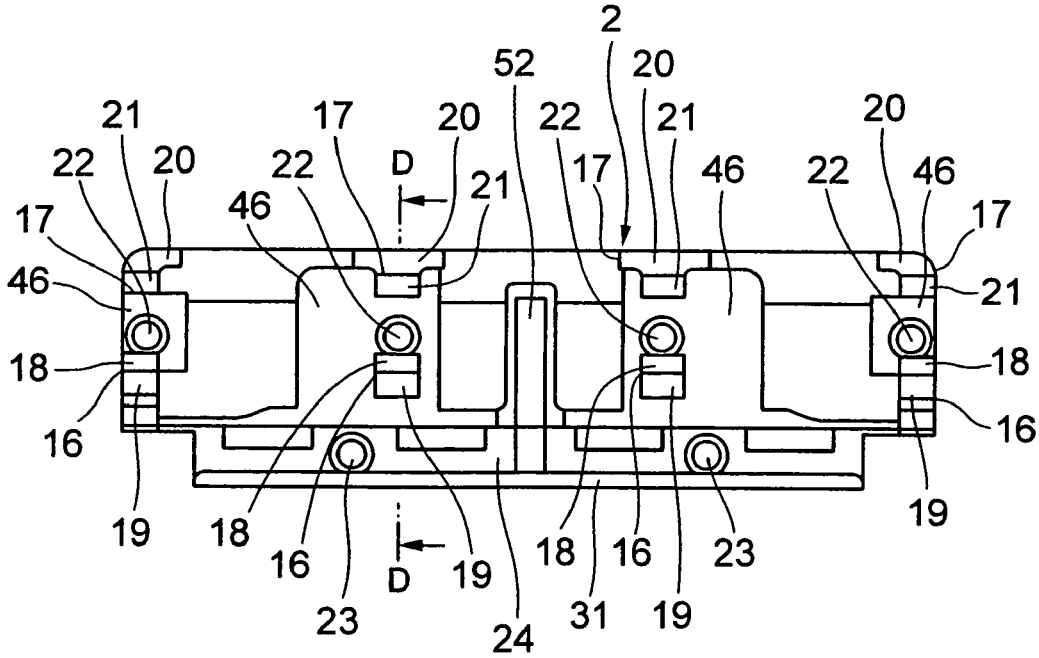
FIG. 8 is a top plan view of the safety razor showing the blade base.
Figure 9:
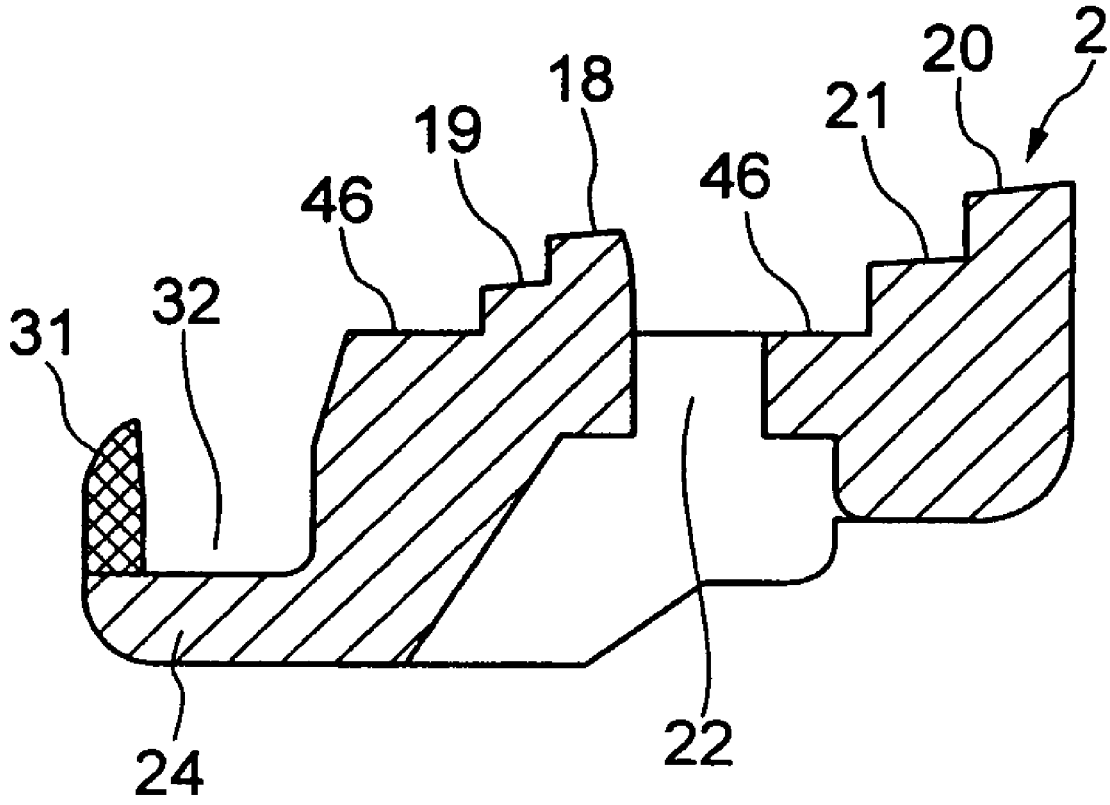
FIG. 9 is a cross sectional view of the safety razor taken along the line D—D in FIG. 8.

FIG. 8 is a top plan view showing the blade base 2, four third blade support parts 16 being arranged in alignment around the middle of an upper surface as shown in the figure. Also, four fourth blade support parts 17 are arranged in alignment along a rear end of the upper surface. Like the first and second blade support parts 7, 8 described above, the third and fourth blade support parts 16, 17 are formed to be stepwise, and steps comprise two steps composed of a second step and a first step. For the third blade support parts 16, the second step 18 is positioned rearward and the first step 19 is positioned forward. For the fourth blade support parts 17, the second step 20 is positioned rearward and the first step 21 is positioned forward.

The reference numeral 22 denotes holes, through which the blade base inserts 13 are inserted. Also, the reference numeral 23 denotes holes provided on a guard base 24 of the blade base 2, and the projections 14, described above, on the roof plate extend through the holes. An elastomer portion 31 is provided upright along a tip end of the guard base 24. The reference numeral 52 denotes an extrusion portion of the elastomer portion 31, the extrusion portion engaging with a groove in the blade base 2 to thereby fix the elastomer portion 31 to the blade base 2 firmly. The guard body 5 of the roof plate is fitted into a groove 32 formed by the guard base 24 and the elastomer portion 31 whereby a surface of the guard is formed such that a surface of the elastomer portion 31 and a surface of the shaving aid 33 extend adjacent to and in parallel to each other.

Figure 10:
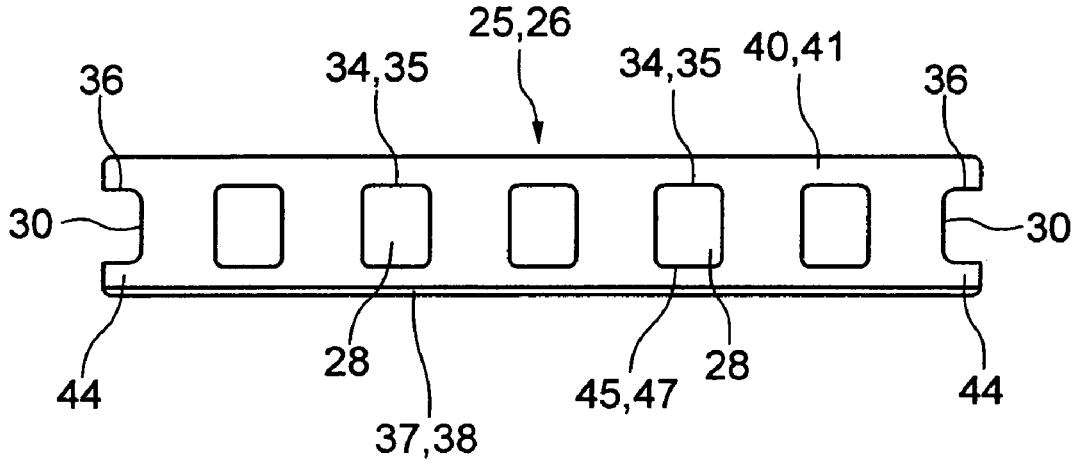
FIG. 10 is a top plan view of a blade that is used as both an upper blade and a middle blade in the safety razor.
Figure 11:
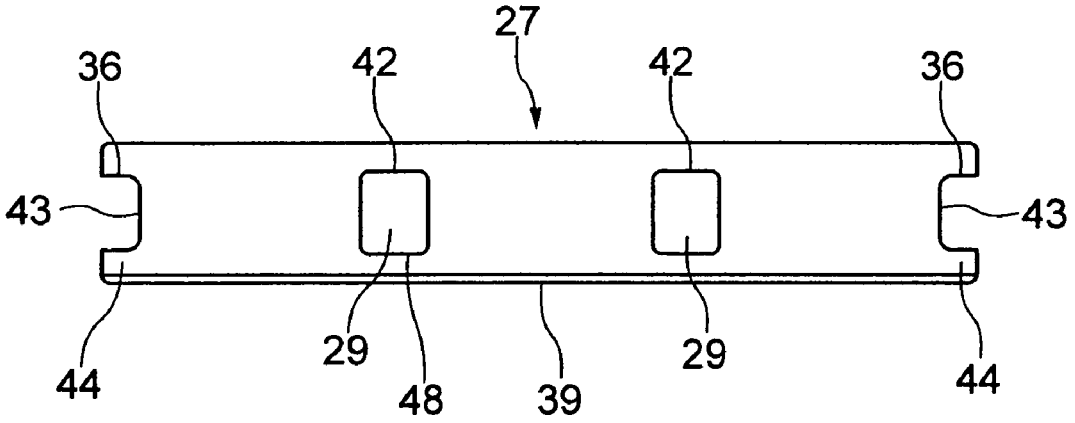
FIG. 11 is a top plan view of a lower blade for used in the safety razor.

Blades used for the cartridge replaceable blade include two kinds, and a blade shown in FIG. 10 is used as an upper blade 25 and a middle blade 26. The blade shown in FIG. 10 comprises five aligned holes 28 and notches 30, 30 at both ends thereof. A blade shown in FIG. 11 is used as a lower blade 27. The blade shown in FIG. 11 comprises two aligned holes 29 and notches 43, 43 at both ends thereof. However, the blades in the invention are not limited to such combination but may be naturally of any combination. Accordingly, all the blades may be ones shown in FIG. 10, or ones shown in FIG. 11.

Figure 12:
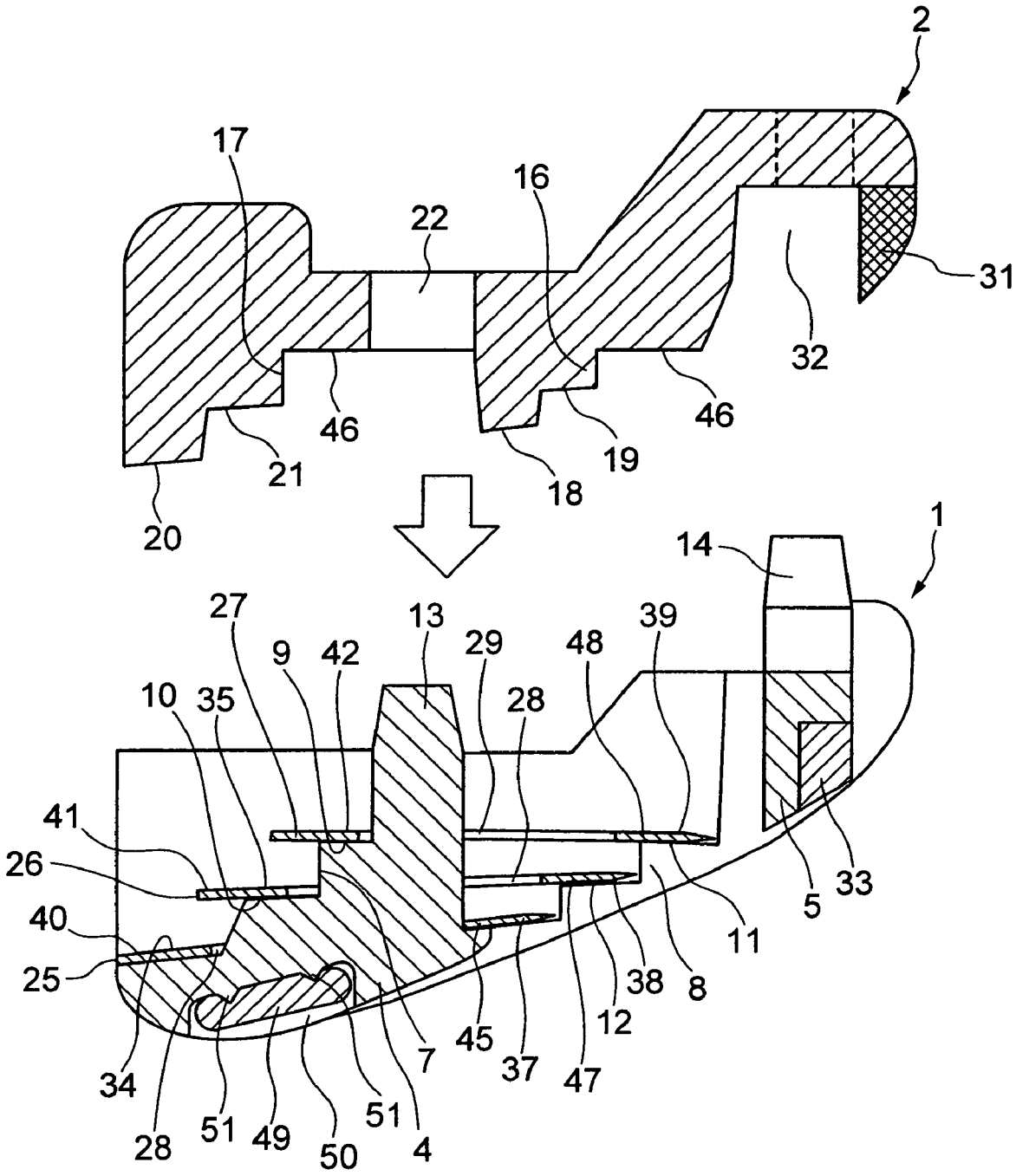
FIG. 12 is an exploded cross-sectional view illustrating assembly of the head of the safety razor.

FIG. 12 is a view showing an assembling method in the invention. As shown in the figure, the roof plate 1 is shown as being inverted, and the upper blade 25 is first placed on the bottom surface 15 (an upper surface in FIG. 12) of the roof plate 1. At this time, the blade base inserts 13 and the first blade support parts 7 are inserted through the holes 28, 28 provided adjacent to the central one, among the five holes 28 in the upper blade.

Subsequently, the middle blade 26 is placed to be shifted a little forwardly of the upper blade 25. Such shifting of the middle blade 26 prevents inner periphery rear edges 34 of the holes in the upper blade from wholly overlapping with inner periphery rear edges 35 of the holes in the middle blade 26, thus generating non-overlapping portions. Owing to the presence of the non-overlapping portions, only the blade base inserts 13 and the second steps 9 of the first blade support parts are inserted through the holes 28, and the first steps 10 are blocked by the inner periphery rear edges 35 of the middle blade to act to support the middle blade. That is, the inner periphery rear edges 35 of the middle blade are supported by the first steps 10 of the first blade support parts. Such supporting is effected between the inner periphery rear edges 36, 36 of the notches 30, 30 at both ends and the first blade support parts 7, 7 provided on the bottom surfaces of the both side portions 3, 3 of the roof plate.

Shifting of the middle blade 26 further prevents a front edge 37 of the upper blade from wholly overlapping with a front edge 38 of the middle blade, thus generating non-overlapping portions. Owing to the presence of the non-overlapping portions, both ends of the front edge 38 of the middle blade are supported on the first steps 12 of the second blade support parts.

After the middle blade 26 is placed in the manner described above, the lower blade 27 is placed in a state to be shifted a little forwardly of the middle blade 26. Shifting of the lower blade 27 prevents the inner periphery rear edges 35 of the holes of the middle blade from wholly overlapping with inner periphery rear edges 42 of the holes of the lower blade, thus generating non-overlapping portions. Owing to the presence of the non-overlapping portions, only the blade base inserts 13 are inserted through the holes 29, and the second steps 9 are blocked by the inner periphery rear edges 42 of the lower blade to act to support the lower blade 27. That is, the inner periphery rear edges 42 of the lower blade are supported by the second steps 9 of the first blade support parts. Such supporting is also effected between the inner periphery rear edges 36, 36 of the notches 30, 30 at both ends and the first blade support parts 7, 7 provided on the bottom surfaces of the both side portions 3, 3 of the roof plate.

Shifting of the lower blade 27 further prevents the front edge 38 of the middle blade 26 from overlapping with a front edge 39 of the lower blade 27, thus generating non-overlapping portions. Owing to the presence of the non-overlapping portions, both ends of the front edge 39 of the lower blade are supported on the second steps 11 of the second blade support parts 8.

As described above, after the upper blade 25, the middle blade 26, and the lower blade 27 are set on the roof plate 1 as inverted, the blade base 2 is joined to the roof plate 1. The roof plate 1 and the blade base 2 are joined together by also inverting the blade base 2, inserting the blade base inserts 13 through the holes 22 of the blade base, inserting the projections 14 through the holes 23 of the blade base, and squashing tip ends of the blade base inserts 13 and the projections 14, which project above the bottom surface of the blade base.

When the roof plate 1 and the blade base 2 are joined together, the second steps 20 of the fourth blade support parts provided on an upper surface (an underside in FIG. 12) of the blade base come into pressure contact with a rear edge portion 40 and the inner periphery rear edges 34 of the upper blade, at which the upper blade 25 and the middle blade 26 do not overlap with each other, and the first steps 21 come into pressure contact with a rear edge portion 41 and the inner periphery rear edges 35 of the middle blade, at which the middle blade 26 and the lower blade 27 do not overlap with each other. Also, an upper surface 46 of the blade base comes into pressure contact with the inner periphery rear edges 42 of the lower blade.

Simultaneously therewith, the second steps 18 of the third blade support parts pass through the holes 29 of the lower blade and the holes 28 of the middle blade to come into pressure contact with inner periphery front edges 45 of the holes of the upper blade, and the first steps 19 pass through the holes 29 of the lower blade to come into pressure contact with inner periphery front edges 47 of the holes of the lower blade. Also, the upper surface 46 of the blade base comes into pressure contact with inner periphery front edges 48 of the holes of the lower blade. Further, the third blade support parts 16 come into pressure contact with inner periphery front edges 44 of the notches of the respective blades.

By assembling the cartridge replaceable blade in the above manner, the inner periphery rear edges 34, 35, 42 of the holes of the respective blades are interposed from above and under in a pressure-contact state, and both ends of the front edge 37, 38, 39 of the respective blades are put into a pressure-contact state from above and under. Also, the inner periphery front edges 45, 47, 48 of the holes of the respective blades are put into a pressure-contact state from under, and the inner periphery front edges 45 of the holes of the respective blades are also pressure-contacted by the blade pressure foot 4. In this manner, the respective blades can be surely fixed by pressure contact on the respective blades. In addition, of course, the invention is not limited to the three-blade arrangement but may be applied to arrangements having two blades, four blades or more. When the cartridge replaceable blade comprises four or more blades, it suffices to increase the number of steps on blade support parts.

Figure 13:
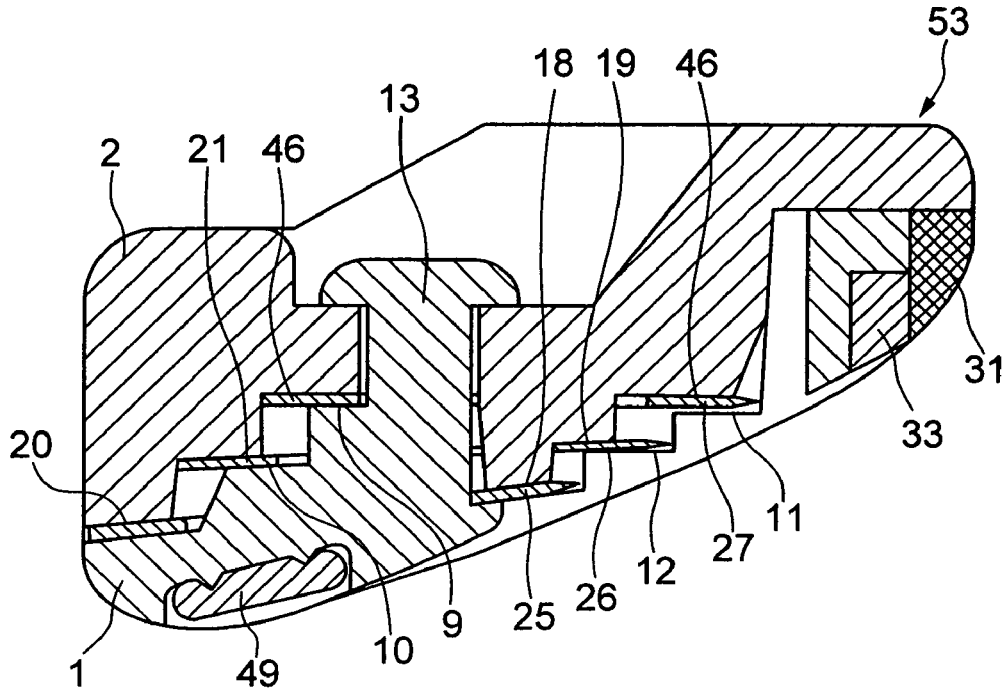
FIG. 13 is a cross sectional view showing a state after the assembly of the head has been completed.

As shown in FIG. 1 or 13, by inclining the second steps and the first steps of the respective stepwise blade support parts 7, 8, 16, 17 a little, the respective blades are made non-parallel to one another and extension lines extending beyond blade edges from the respective blades intersect one another ahead of the blade edges. Also, when the second steps and the first steps are reversely inclined, setting can be made so that extension lines of the respective blades diverge ahead of the blade edges. It suffices that an inclination of the middle blade 26 relative to the lower blade 27 and an inclination of the upper blade 25 relative to the middle blade 26, respectively, be not much more than 5 degrees. Accordingly, such inclination may be 1, 2, 3, or 4 degrees. Preferably, the inclination is around 3 degrees. Based on this, an inclination of the upper blade relative to the lower blade 27 will become around 10 degrees. However, of course, the invention is not limited to such numerical value.

Figure 19:
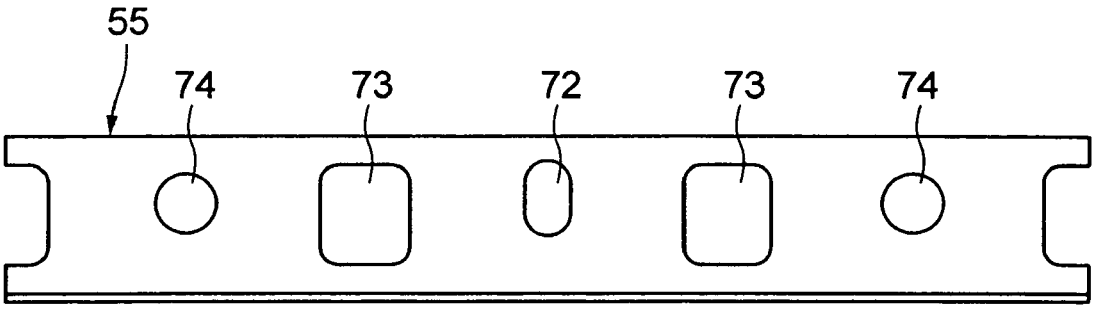
FIG. 19 is a top plan view showing a middle blade for use in the head of FIG. 14.
Figure 20:
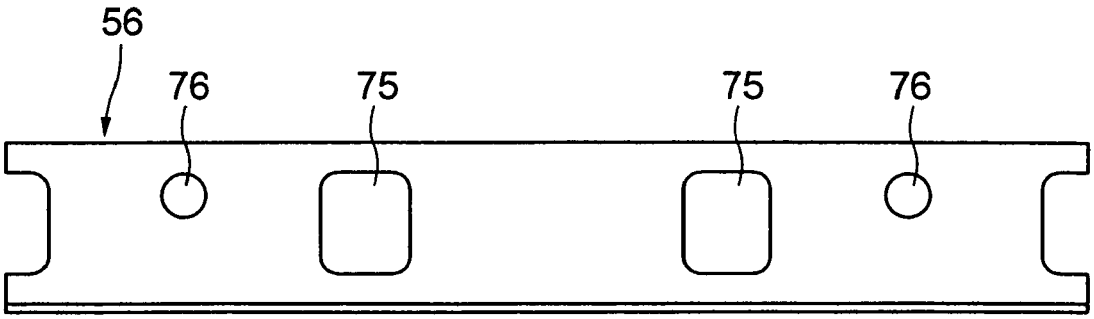
FIG. 20 is a top plan view showing a lower blade for use in the head of FIG. 14.
Figure 21:
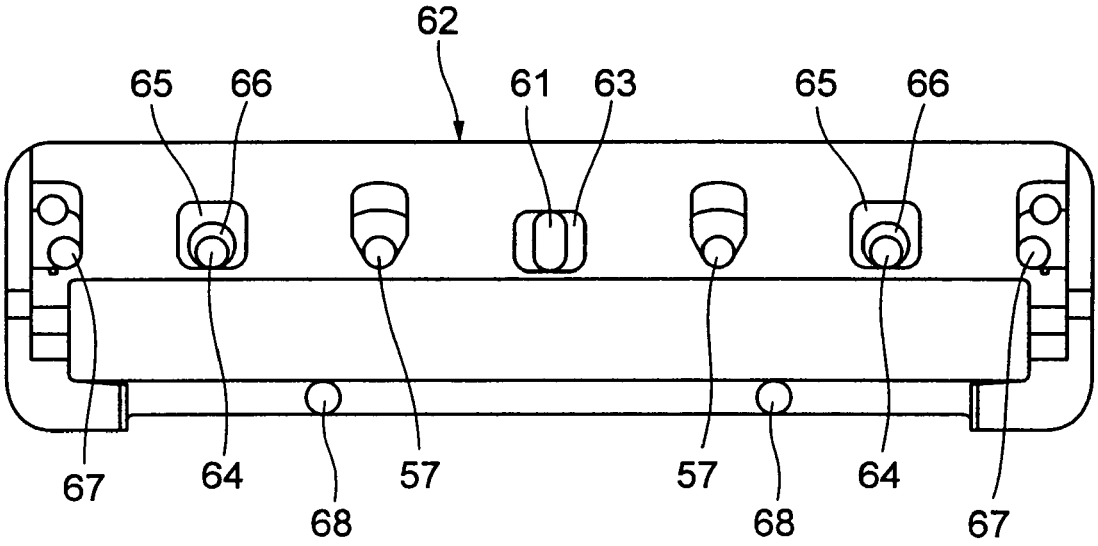
FIG. 21 is a bottom view showing the roof plate of the head of FIG. 14.

FIGS. 14 to 23 are views showing an embodiment of the invention according to claim 19. The embodiment provides a safety razor having three blades, and since a constitution, in which an upper blade 54, a middle blade 55, and a lower blade are shifted from and stacked on one another, is substantially the same as that in the embodiment described above, an explanation thereof is omitted. As shown in FIG. 21, the embodiment is different from the embodiment described above in that blade support parts 57, 57 are rounded as compared therewith.

Figure 16:
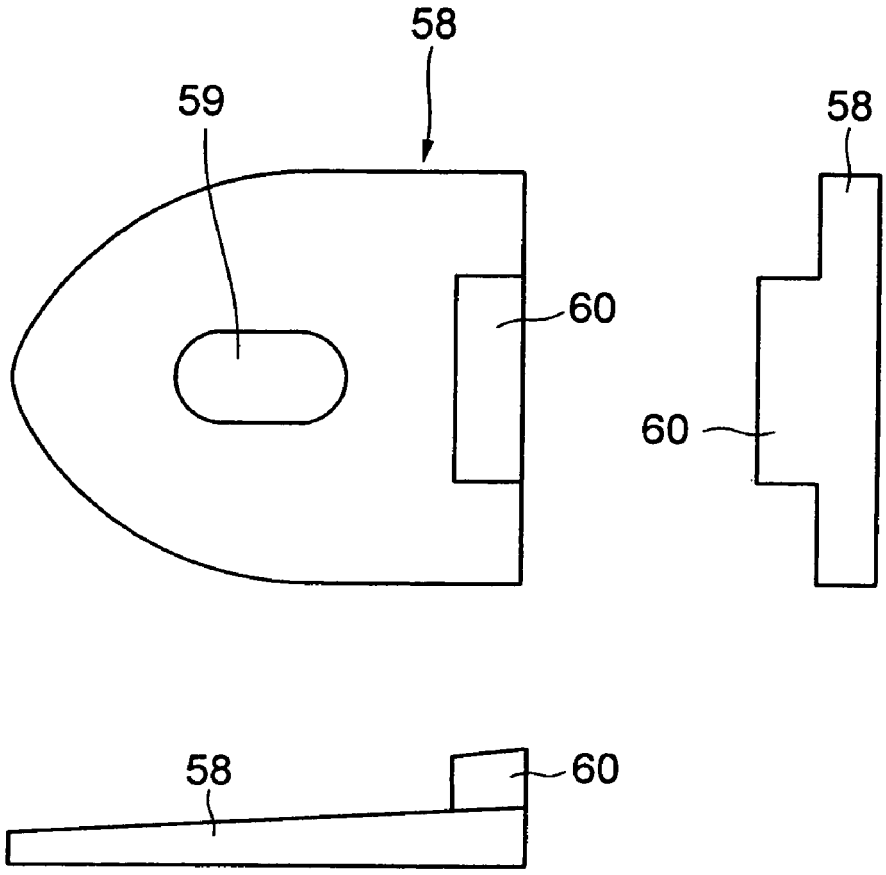
FIG. 16 is a top plan view, a back side view, and a side view of a spacer member for use in the head of FIG. 14.
Figure 17:
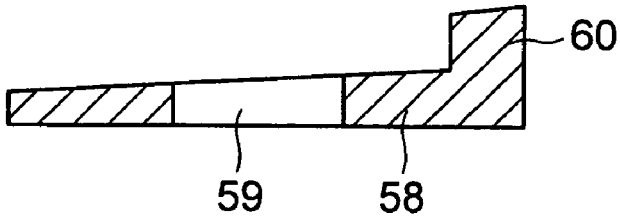
FIG. 17 is a cross sectional view of the spacer member of FIG. 16.

As shown in FIG. 16, a spacer member 58 is in the form of a small piece to be integrally made of plastics, the spacer member being formed centrally thereof with an insertion hole 59 and provided at a rear end thereof with an upward directed projection 60. The insertion hole 59 may be a through-hole or concave in shape. A projection 61 being inserted into the insertion hole 59 is provided on a bottom surface of a roof plate 62. As shown in FIG. 21, a pedestal 63 is provided on a root of the projection 61. The reason for the provision of the pedestal 63 is that by interposing the pedestal 63 between the upper blade 54 and the middle blade 55, a gap is retained between the upper blade 54 and the middle blade 55 in the same manner as steps on the blade support parts 57, 57.

Auxiliary projections 64, 64 are integrally provided outside the blade support parts 57, 57, and first steps 65 and second steps 66 are provided stepwise. The auxiliary projections 64, 64 act to have the second steps brought into pressure contact with the lower blade 56 to surely fix the lower blade.

Figure 14:
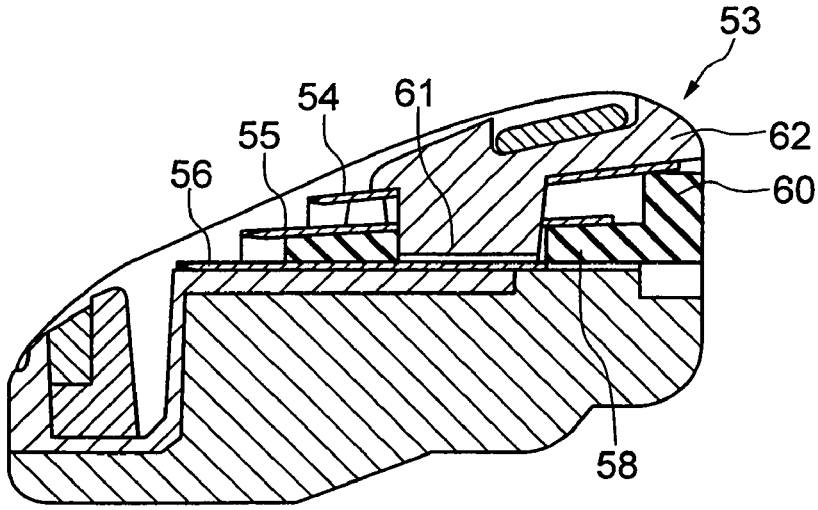
FIG. 14 is a cross sectional view of a head according to another embodiment showing the locations of the blades.
Figure 15:
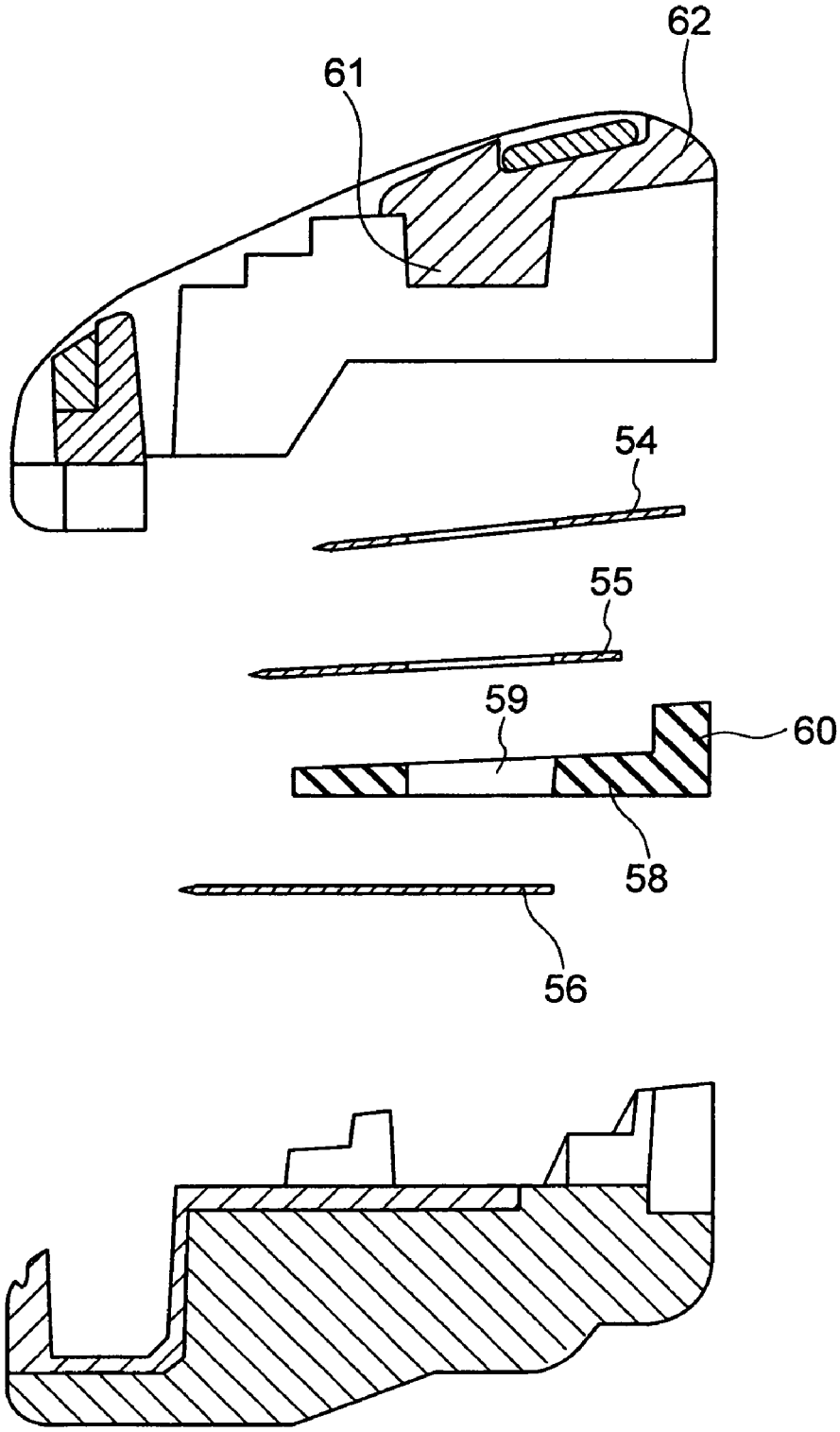
FIG. 15 is an exploded, cross sectional view showing the head of FIG. 14.
Figure 22:
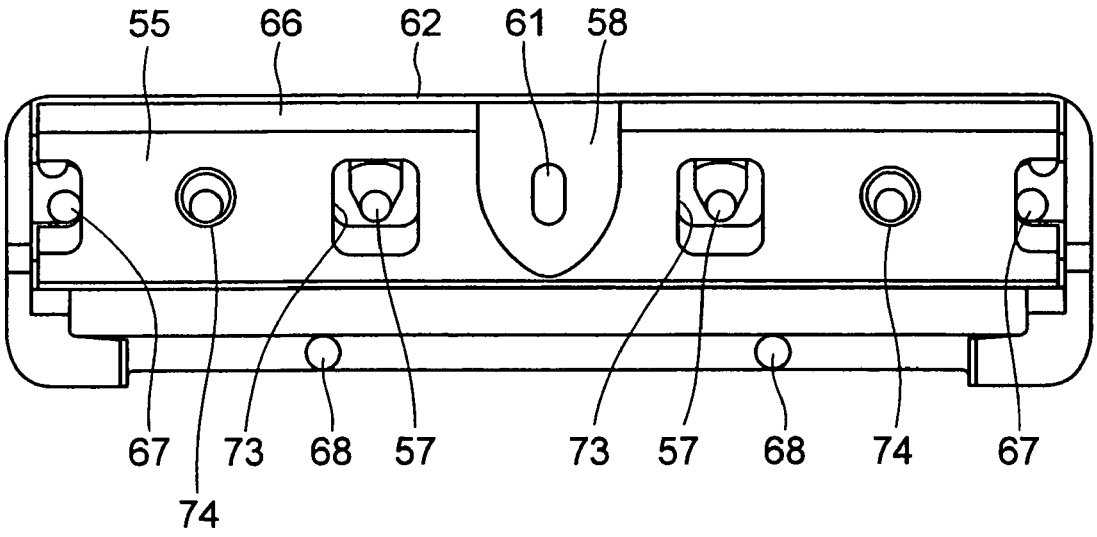
FIG. 22 is a top plan view showing a state, in which the upper blade, the middle blade, and the spacer member are stacked on the roof plate made upside down according to one embodiment of the present invention.

Subsequently, a method of assembling the spacer member 58 and other members together will be described. FIG. 22 shows a state, in which the roof plate 1 is upside down and the upper blade 54 and the middle blade 55 are stacked on each other with a spacing therebetween. As shown in FIG. 14, a projection 60 of the spacer member bears on the upper blade 54 with non-overlapping portions of the middle blade 55 and the upper blade 54 therebetween, and the projection 61 is inserted into the insertion hole 59. In this state, the middle blade 55 is pushed by the spacer member 58 and there is no fear of slippage. Thereafter, the lower blade 56 is further stacked, and respective blade base inserts 67, 67 on both sides and projections 68, 68 at a front end are inserted and fitted into holes of the blade base, thus achieving assembling as shown in FIG. 14.

Figure 18:
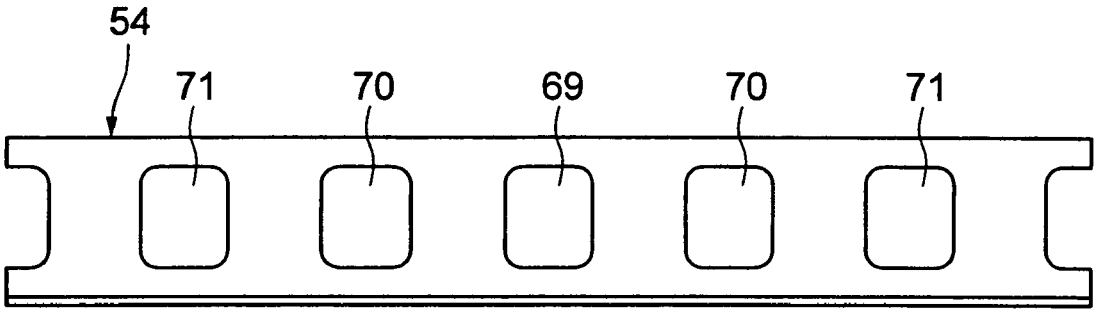
FIG. 18 is a top plan view showing an upper blade for use in the head of FIG. 14.
Figure 23:
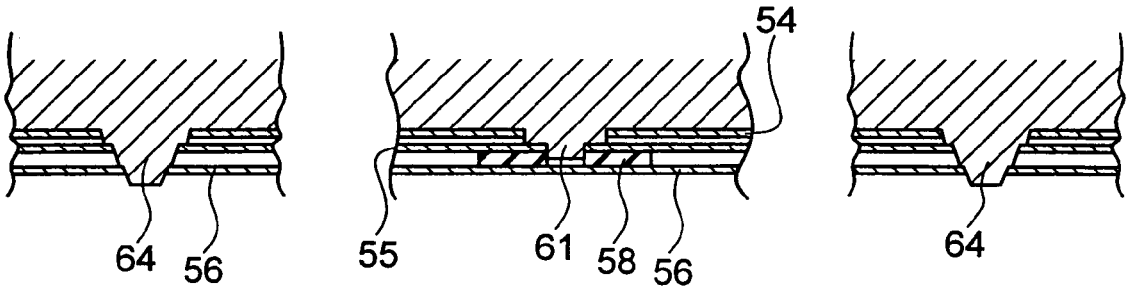
FIG. 23 is a partial, cross sectional view showing the head fully assembled.

FIG. 18 shows the upper blade 54 comprising a central hole 69, through which the projection 61 is inserted, holes 70, 70, which are disposed on both sides thereof and through which the blade support parts 57, 57 are inserted, and holes 71, 71, which are disposed outside and through which the auxiliary projections 64, 64 are inserted. FIG. 19 shows the middle blade 55 comprising a central hole 72, through which the projection 61 is inserted, holes 73, 73, which are disposed on both sides thereof and through which the blade support parts 57, 57 are inserted, and holes 74, 74, which are disposed outside and through which the auxiliary projections 64, 64 are inserted. FIG. 20 shows the lower blade 56 comprising holes 75, 75, which are disposed to a center and through which the blade support parts 57, 57 are inserted, and holes 76, 76, which are disposed outside and through which tip ends of the auxiliary projections 64, 64 are inserted. A state, in which respective blades are supported by actions of the auxiliary projections 64, 64 and the respective holes, is easly understandable from FIG. 23. An action of the projection 61 shown centrally in FIG. 23 is described below. As shown in FIG. 23, the projection 61 comprises a central step, the step pushing the middle blade 55 downward, the thus pushed middle blade 55 pushing the spacer member 58 downward, and further the pushed spacer member 58 biasing the lower blade 56 to prevent the lower blade from coming up. In addition, of course, the spacer member 58 is not limited to one in number but a plurality of spacer members may be mounted.

Figure 31:
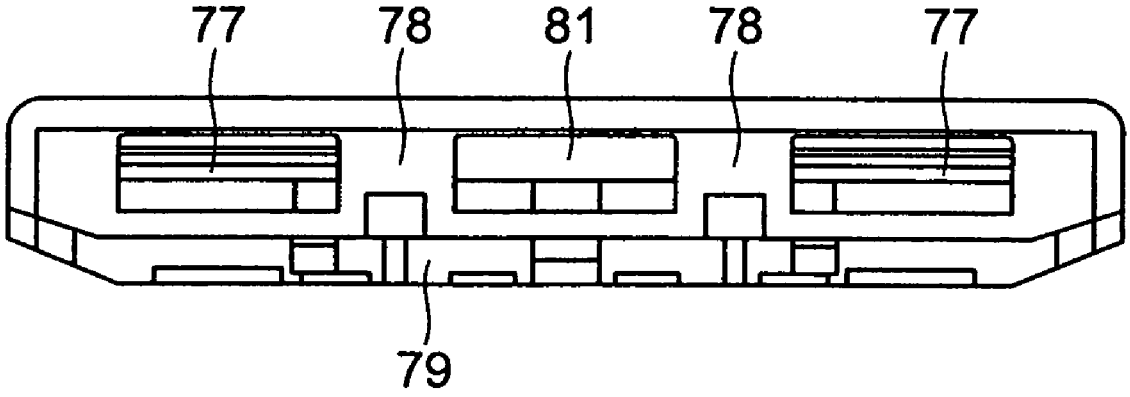
FIG. 31 is a back side view showing the head of FIG. 24.

FIGS. 24 to 31 are views showing an embodiment of the invention according to claims 20 to 22. A head 53 according to the invention comprise rear end openings 77 as shown in FIG. 31. The rear end openings 77 may be partially covered by ribs 78 as shown in FIG. 31, or the rear end openings 77 may extend over an entire width of the head 53 with no ribs 78. While the ribs 78 are formed integral with a blade base 79, they are not limited to such structure but may be formed integral with, for example, a roof plate 80.

FIGS. 25 to 29 show a structure of an insert spacer 81 used in a safety razor having three blades. The insert spacer 81 is integrally formed of plastics to comprise two upper insert pieces 83, 83 and a single lower insert piece 84, these insert pieces being different in level to extend substantially horizontally from a base end 82, and a spacing corresponding substantially to a thickness of a blade is present between the upper insert pieces and the lower insert piece. The lower insert piece 84 is present between the upper insert pieces 83, 83, and the respective lower and upper insert pieces are aligned laterally alternately. Latch projections 85, 85, respectively, are provided on both sides of the insert spacer 81. When mounted on the head 53, the latch projections 85, 85 latch on the ribs 78 to prevent the insert spacer 81 from coming out of the head 53.

Figure 24:
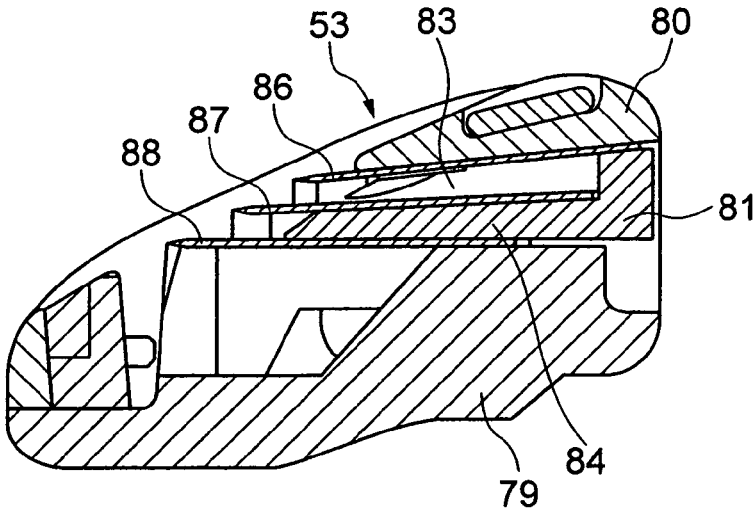
FIG. 24 is a cross sectional view of a safety razor head according to an alternative embodiment.
Figure 25:
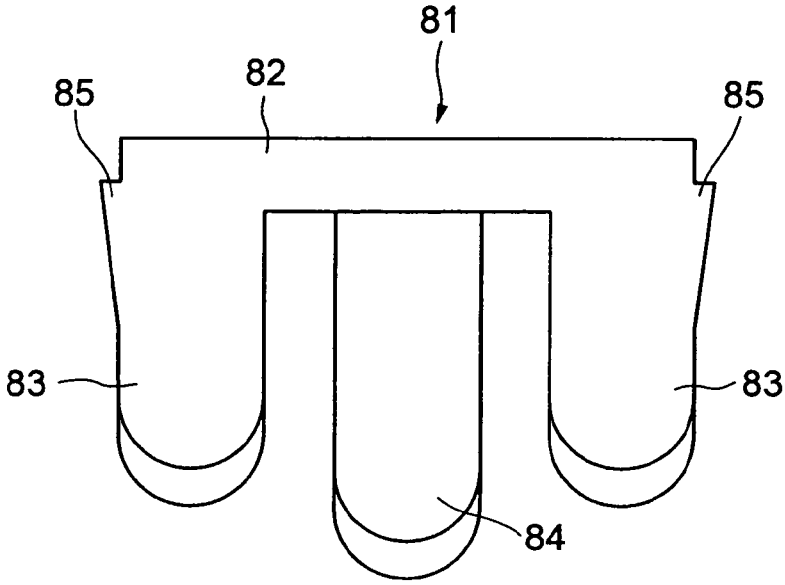
FIG. 25 is a top plan view showing an insert spacer for use in the head of FIG. 24.
Figure 26:
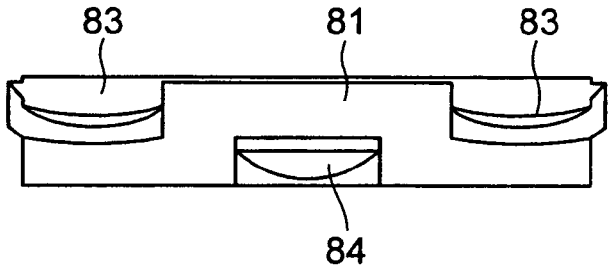
FIG. 26 is a front view of the insert spacer of FIG. 25.
Figure 27:
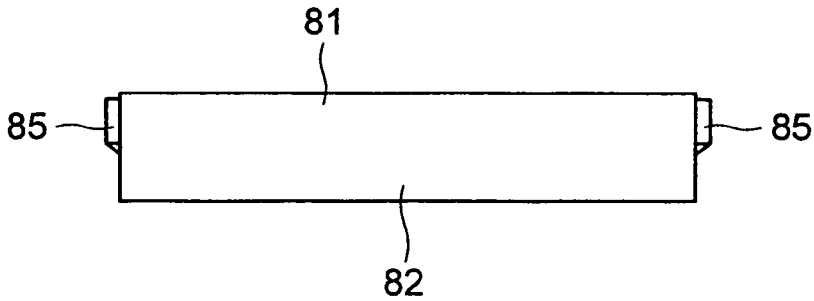
FIG. 27 is a back side view of the insert spacer of FIG. 25.
Figure 28:
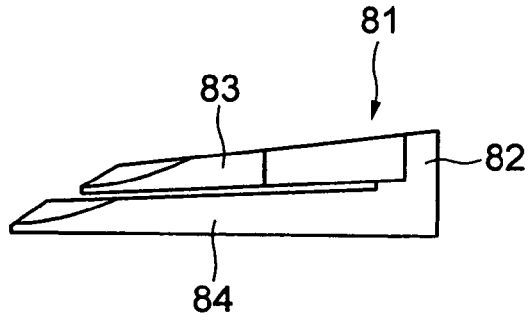
FIG. 28 is a side view of the insert spacer of FIG. 25.
Figure 29:
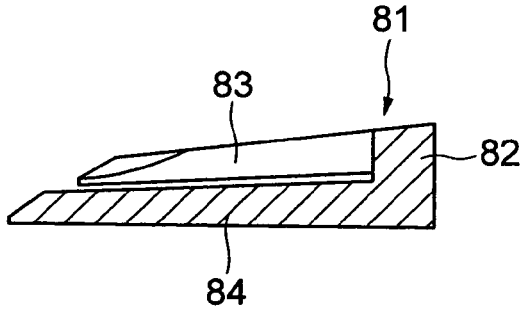
FIG. 29 is a cross sectional view of the insert spacer of FIG. 25.
Figure 30:
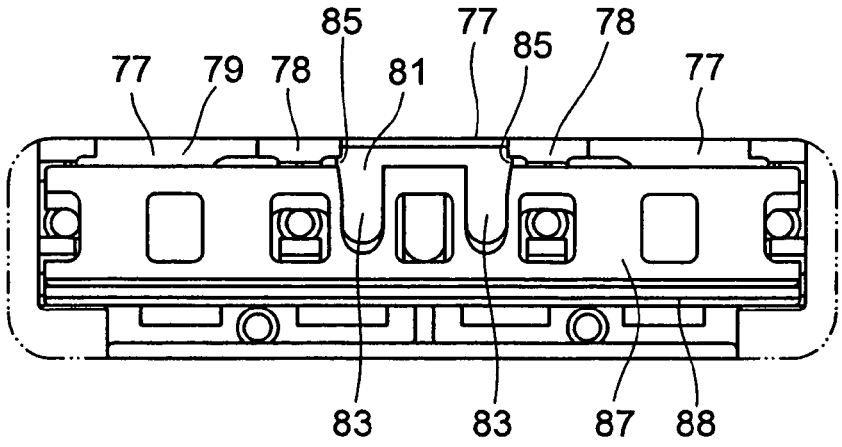
FIG. 30 is a top plan view of the head of FIG. 24, with a roof plate and an upper blade being removed from the head.

As apparent from FIGS. 28 and 29, the upper insert pieces 83 and the lower insert piece 84 are formed to be gradually reduced in thickness toward tip ends thereof. This is intended for corresponding to that configuration, in which respective extension lines of an upper blade 86, a middle blade 87, and a lower blade 88 along directions of blade edge intersect one another ahead as shown in FIG. 24.

Subsequently, a method of mounting the insert spacer 81 on the head 53 is described. A width of the insert spacer 81 amounts to a length insertable between the both ribs 78, 78. The insert spacer 81 is mounted on the head 53 by inserting the upper insert pieces 83, 83 of the insert spacer between the upper blade 86 and the middle blade 87 in a manner to insert the same into the rear end openings 77 disposed centrally, and inserting the lower insert piece 84 between the middle blade 87 and the lower blade 88. When the insert spacer 81 is fully inserted, the latch projections 85, 85 latch on back surfaces of the ribs 78, so that the insert spacer 81 will not come out after mounting.

Of course, the insert spacer is not limited to such configuration but a plurality of insert spacers may be mounted on the head. Also, instead of relying on the above-mentioned latch structure, a way to fix the insert spacer may be such that, for example, a thickness of the upper and lower insert pieces 83, 84 is made larger than a spacing between adjacent blade bodies to achieve press fit.

The invention claimed is:

1. A safety razor comprising a head provided with a plurality of vertically adjacent blades, which do not wholly overlap one another, and blade support parts supporting the respective blades apart from one another in order to retain the respective blades at spaces, and wherein non-overlapping portions, which do not overlap one another, are formed on supported portions of the respective blades and the blade support parts are held to the non-overlapping portions of the blades to support the blades, wherein the blade support parts include a single blade base and a single opposing roof plate, each of which has an integral stepped structure defined by a number of adjacent steps, each step defining a support surface against which one respective blade rests such that when the blade base and roof plate are coupled to one another, each blade intimately contacts and is held between two pairs of different opposing steps of each of the blade base and roof plate to cause the blades to be supported in different levels between the blade base and roof plate, with one pair of steps supporting a rear section of the blade and the other pair of steps supporting a front section of the blade, wherein the steps of each of the blade base and roof plate are formed as part of a single, integral body, wherein the roof plate includes projecting members that are each inserted through aligned openings formed in the respective blades and through an opening formed in the blade base, with a head being formed at the end of each projecting member external to the blade base to join the blade base to the roof plate.

2. The safety razor according to claim 1, wherein the projecting members project from a bottom surface of the roof plate to be inserted through the openings of the respective blades and the openings of the blade base in order to interpose the blades between the blade base and the roof plate support those blades, which are disposed below an upper blade.

3. The safety razor according to claim 2, wherein steps are provided midway the projections and the steps support those blades, which are disposed below the upper blade, from above.

4. The safety razor according to claim 1, wherein the support surface is a planar surface.

5. The safety razor according to claim 1, wherein the integral stepped structures are formed such that both a forward and rear section of the blade are intimately held between opposing steps formed as part of the blade base and roof plate.

6. The safety razor according to claim 1, wherein a vertical shoulder is formed between adjacent steps to space the blades in the different levels.

7. The safety razor according to claim 1, wherein one support surface is formed at an angle relative to one adjacent support surface so as to cause one respective blade to be inclined relative to one vertically adjacent blade.

8. The safety razor according to claim 1, wherein each blade is sandwiched between two opposing planar support surfaces.

* * * * *